US005429340A

United States Patent [19]

Young et al.

[11] Patent Number: 5,429,340

[45] Date of Patent: Jul. 4, 1995

[54] MODULAR SECURITY FENCE

[76] Inventors: Anthony M. Young, 4724 Nash St., Chapel Oaks, Md. 20747; Anthony J. Gary, 8720 Ritchboro Rd.,, Forestville, Md. 20747

[21] Appl. No.: 917,370

[22] Filed: Jul. 23, 1992

[51] Int. Cl.[6] ..... E04H 17/14

[52] U.S. Cl. ..... 256/24; 256/1; 256/73; 403/340; 403/4; 52/28; 52/272

[58] Field of Search ..... 256/1, 73, 24, 27, 30, 256/25, 19; 52/272, 28, 536, 538; 403/340, 339, 403, 4; 160/135

[56] References Cited

U.S. PATENT DOCUMENTS

| | | | |
|---|---|---|---|
| D. 248,571 | 7/1978 | Herbst . | |
| 1,506,656 | 8/1924 | Murphy . | |
| 2,877,600 | 3/1959 | Slate . | |
| 3,883,120 | 5/1975 | Tippmann | 256/24 |
| 4,063,714 | 12/1977 | Kirkwood . | |
| 4,111,401 | 9/1978 | Pickett | 256/13.1 |
| 4,357,000 | 11/1982 | Tisbo et al. . | |
| 4,930,753 | 6/1990 | Alvyn . | |
| 5,044,135 | 9/1991 | Kroon et al. | 160/135 X |

FOREIGN PATENT DOCUMENTS

| | | | |
|---|---|---|---|
| 2820726 | 11/1979 | Germany | 160/135 |

*Primary Examiner*—Randolph A. Reese
*Assistant Examiner*—Christopher J. Novosad
*Attorney, Agent, or Firm*—Richard C. Litman

[57] ABSTRACT

The present invention relates to a modular security fence and, more particularly, to a plurality of interconnectable fence panels, each fabricated of weather proof recyclable materials. The fence panels can be produced in a variety of colors and sizes ranging from decorative landscaping fences to privacy fences. No staining or painting is required. These fence panels are formed to interconnect with one another and are secured together, preferably, through the use of threaded fasteners. Each successive panel conceals the unsightly fasteners which secure the preceding interconnected panel. The fence panels require virtually no maintenance. A number of panels can be interconnected prior to distribution, thus providing preassembled sections of fence. Optional panels may be formed to include utility boxes to accommodate electrical devices such as light fixtures, receptacles, and security devices. A fence of this type is durable, demanding little repair, and is not likely to fall prey to vandalism.

18 Claims, 3 Drawing Sheets

MODULAR SECURITY FENCE

BACKGROUND OF THE INVENTION

1. FIELD OF THE INVENTION

The present invention relates to a modular security fence and particularly, to a plurality of interconnectable fence panels, each fabricated of weather proof recyclable materials.

2. DESCRIPTION OF THE PRIOR ART

U.S. Pat. No. 1,506,656 issued Aug. 26, 1924 to William Murphy discloses an improvement in the construction of insulated walls. The walls consist of interlocking planks, each plank having inner and outer casing walls to provided inner and outer air spaces in the wall construction. A mating tongue and groove arrangement is provided along each of the longitudinal edges. The walls are configured to provide a weather proof structure. The planks may be of any size.

U.S. Pat. No. 2,877,600 issued Mar. 17, 1959 to Claude C. Slate describes a fence constructed of a plurality of sections, each section including a center wall and a lower pointed end. The lower pointed end is adapted to be driven into a supporting surface, namely the ground, so as to permit a small projecting flange or tab to rest against the top of the supporting surface. Each section is provided with mating congruent ends.

U.S. Pat. No. 4,063,714 issued Dec. 20, 1977 to Robert E. Kirkwood discloses a fence formed from prefabricated sections that readily fit together. The fence includes vertical member, each fitted with clips to fasten to horizontal spacers, a pair of horizontal spacers of a U-shaped section and a pair of horizontal spacers of an H-shaped section, together with flat panels that fit into the recesses of the U-shaped and H-shaped spacers.

U.S. Pat. No. 4,930,753 issued Jun. 5, 1990 to Alvin E. Alvyn describes a molded edge connecting apparatus suitable for use as a fencing. The structure of the apparatus is substantially coplanar having molded connecting fingers disposed along the elongated edges.

Additional patents which may be deemed of interest include U.S. Pat. No. 4,357,000 issued Nov. 11, 1982 to Cosmo N. Tisbo et al. and U.S. Pat. No. Des. 248,571 issued Jul. 18, 1978 to Lewis R. Herbert.

None of the above inventions and patents, taken either singly or in combination, is seen to describe the instant invention as claimed.

SUMMARY OF THE INVENTION

The present invention relates to a modular security fence and, more specifically, to interconnectable fence panels fabricated of weather proof recyclable materials. The fence panels may be produced in various colors displayed in solids or patterns, such as brick or picket patterns, and requiring no staining or painting. The fence panels, ranging in sizes varying from decorative landscaping fences to privacy fences, are configured to interconnect with one another. The unique configuration of these fence panels ensures that each successive fence panel conceals the fasteners which secure the preceding interconnected panels. By concealing the fasteners and due to the durability of the fence panels, virtually no maintenance is required. A number of panels is interconnected providing prefabricated fence sections. These prefabricated sections demand fewer man hours to erect the fence at its designated location. Optional panels may include utility boxes to accommodate electrical devices such as flood lights, recess lights, plugs or receptacles, and security devices (i.e. motion detectors). A fence of this type would involve little repair, and is not likely to fall prey to vandalism.

Accordingly, it is a principal object of the invention to provide a security fence having fence panels fabricated of weather proof recyclable materials.

It is another object of the invention to provide a modular security fence having fence panels produced in various colors displayed in solids or patterns and, thus requiring no staining or painting.

It is further an object of the invention to provide a modular security fence having fence panels which range in sizes varying from decorative landscaping fences to privacy fences.

It is still another object of the invention to provide a modular security fence having fence panels being configured to interconnect with one another and having a unique configuration which ensures that each successive fence panel conceals the fasteners which secure the preceding interconnected panel.

It is yet another object of the invention to provide a modular security fence having durable fence panels requiring virtually no maintenance.

Another object of the invention to provide a modular security fence having a number of interconnected fence panels providing a prefabricated fence section, thus demanding fewer man hours to erect the fence at its designated location.

Further, an object of the invention to provide a modular security fence having optional fence panels which include utility boxes to accommodate electrical devices such as flood lights, recess lights, plugs or receptacles, and security devices (i.e. motion detectors).

Still, another object of the invention to provide a modular security fence having fence panels which would involve little repair and which would not be likely to fall subject to vandalism.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
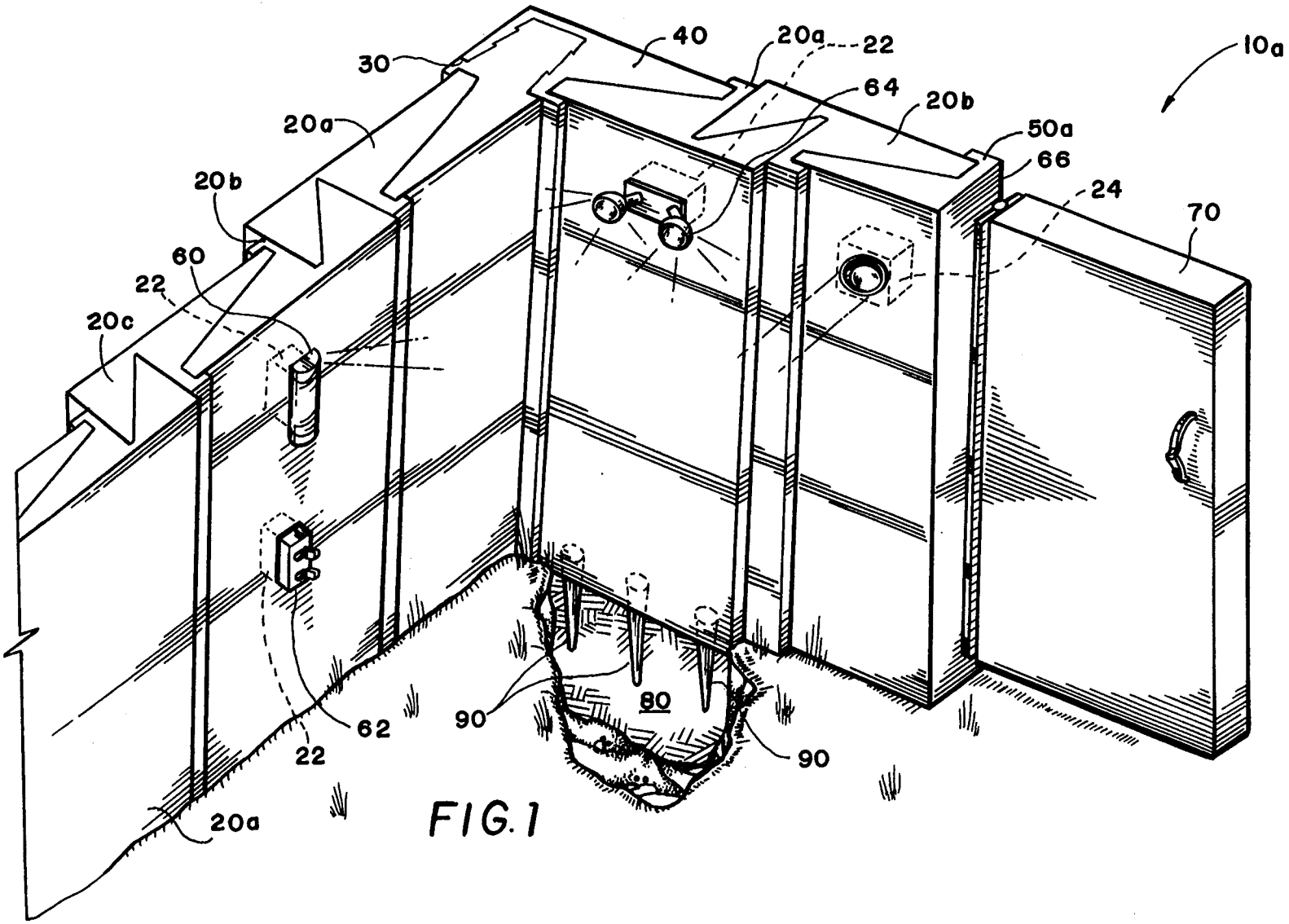
FIG. 1 is environmental perspective view of the present invention.

The present invention, as shown in FIG. 1, is a modular security fence 10*a* comprising a plurality of intermediate fence panels 20*a*,20*b*,20*c*, a male corner panel 30, a female corner panel 40, and an end panel 50*a*. The panels may be configured to include electrical boxes, such as the single gang boxes 22 and the recess canister 24 shown. The single gang boxes 22 may accommodate electrical devices such as the motion detector 60, the outdoor weather proof duplex receptacle 62, the directional flood lights 64, and the recess trim kit 66 shown.

The security fence 10*a* may also include a gate 70 to permit a flow of traffic therethrough. A lower portion of the fence 10*a*, or each individual panel thereof, is buried a predetermined distance beneath the supporting surface, that is the ground 80. Alternatively, stakes 90, which may easily penetrate the ground 80, may project from the bottom of the fence 10*a*, or from each individual panel thereof, to provide auxiliary support for the same.

Figure 2:
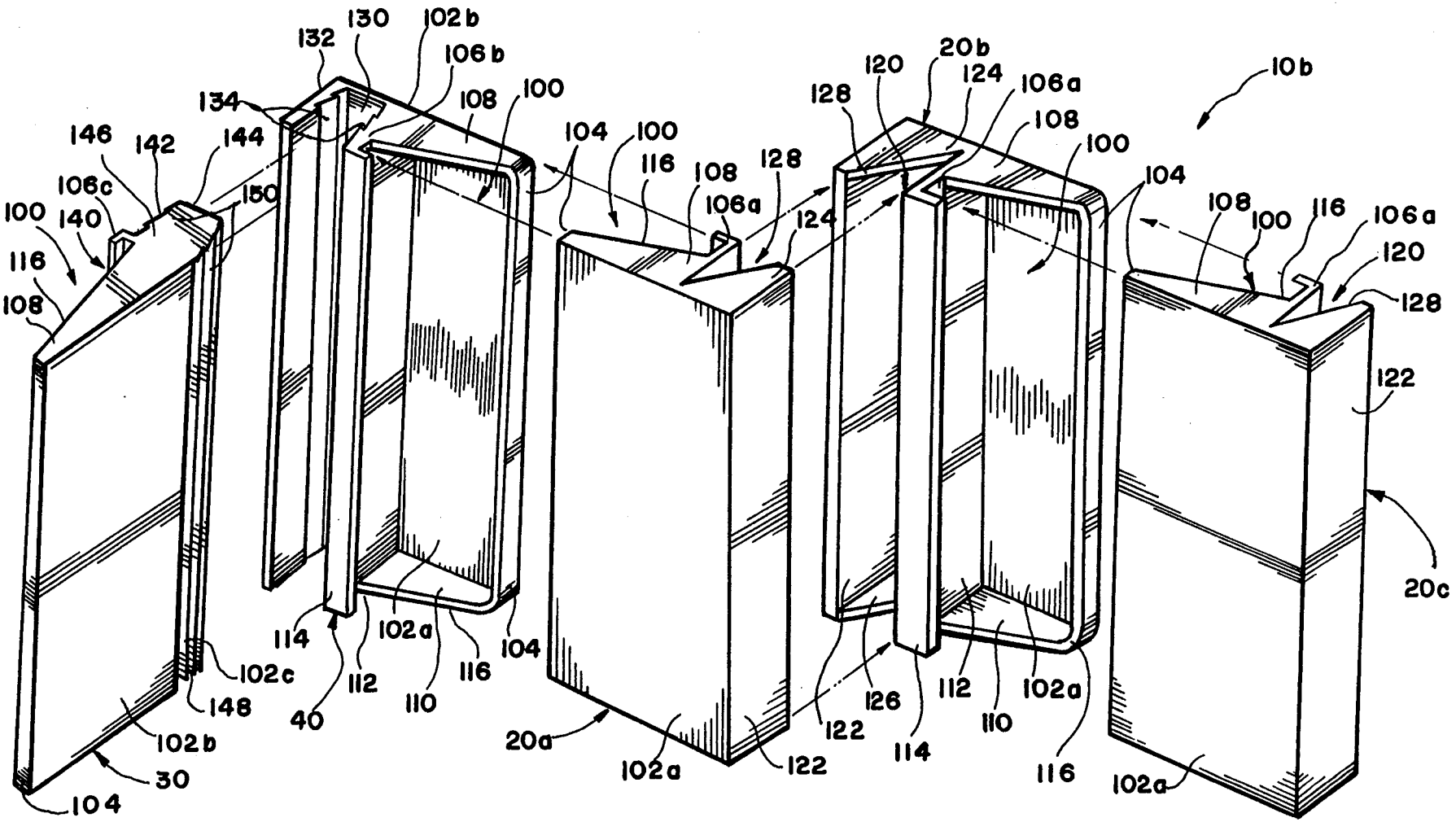
FIG. 2 is an exploded perspective view of the present invention.

Now, referring to FIG. 2 of the modular security fence 10*b*, common to all panels is a first cavity 100 bound by a portion of surface 102*a*,102*b* and four peripheral walls, specifically a narrow outer vertical wall 104, a wider L-shaped vertical wall 106*a*,106*b*,106*c* disposed parallel to the narrow outer wall, and upper and lower substantially parallel, horizontal walls 108,110. The upper and lower walls 108,110, each graduate from the narrow wall 104 to the wider L-shaped wall 106*a*,106*b*,106*c*. The L-shaped wall 106*a*,106*b*,106*c* is defined by an elongated substantially planar wall 112 having a flange 114 integrally attached perpendicular thereto. Due to the symmetry, the edges of these four peripheral walls embody congruent, slidably engagable surfaces 116.

The intermediate fence panel 20*a*,20*b*,20*c* includes a second cavity 120 bound also by four peripheral walls as well as by a remaining portion of the planar surface 102*a*. These four peripheral walls include a wider outer vertical wall 122, an opposing side of the wider L-shaped vertical wall 106*a* disposed in a parallel relation to the wider outer wall 122, and upper and lower substantially parallel, horizontal walls 124,126. The upper and lower walls 124,126, each increase in surface area gradually from the L-shaped wall 106*a* to the wider outer wall 122. The edges of these four peripheral walls also represent complementary, slidably engagable surfaces 128. The orientation of mating surfaces 116,128 of one intermediate fence panel 20*a*,20*b*,20*c* is inverted and opposed to respectively mate with the same mating surfaces 116,128 of another intermediate fence panel 20*a*,20*b*,20*c*.

The female corner panel 40 includes a channel 130. This channel 130 is defined by the remaining portion of the planar surface 102*a* and two vertically disposed parallel walls. The two peripheral walls include a wider outer vertical wall 132 and the wider L-shaped vertical wall 106*b*. The opposing inner surfaces of these two walls 132,106*b* are each configured with stepwise progressing ridges 134.

The male corner panel 30 includes a hollow enclosure 140 delineated by a recessed portion of the planar surface 102*c*, an elongated wall 142 opposite and parallel to the planar surface 102*c*, and four peripheral walls. These four peripheral walls comprise a substantially planar end wall 144, an opposing side of the wider L-shaped vertical wall 106*c* disposed in a parallel relation to the end wall 144, and upper and lower substantially parallel, horizontal walls 146,148. The upper and lower walls 146,148 each extend from the planar surface 102*c* to the elongated wall 142 and from the end wall 144 to the L-shaped wall 106*c* to fully enclose the enclosure 140. The planar surface 102*c* and the elongated wall 142 are each configured to have outwardly directed, stepwise progressing ridges 150 which couple with the stepwise progressing ridges 134 of the female corner panel 40, thus forming male and female corner panels 30,40 which mate to provide a snap fit configuration.

Figure 3:
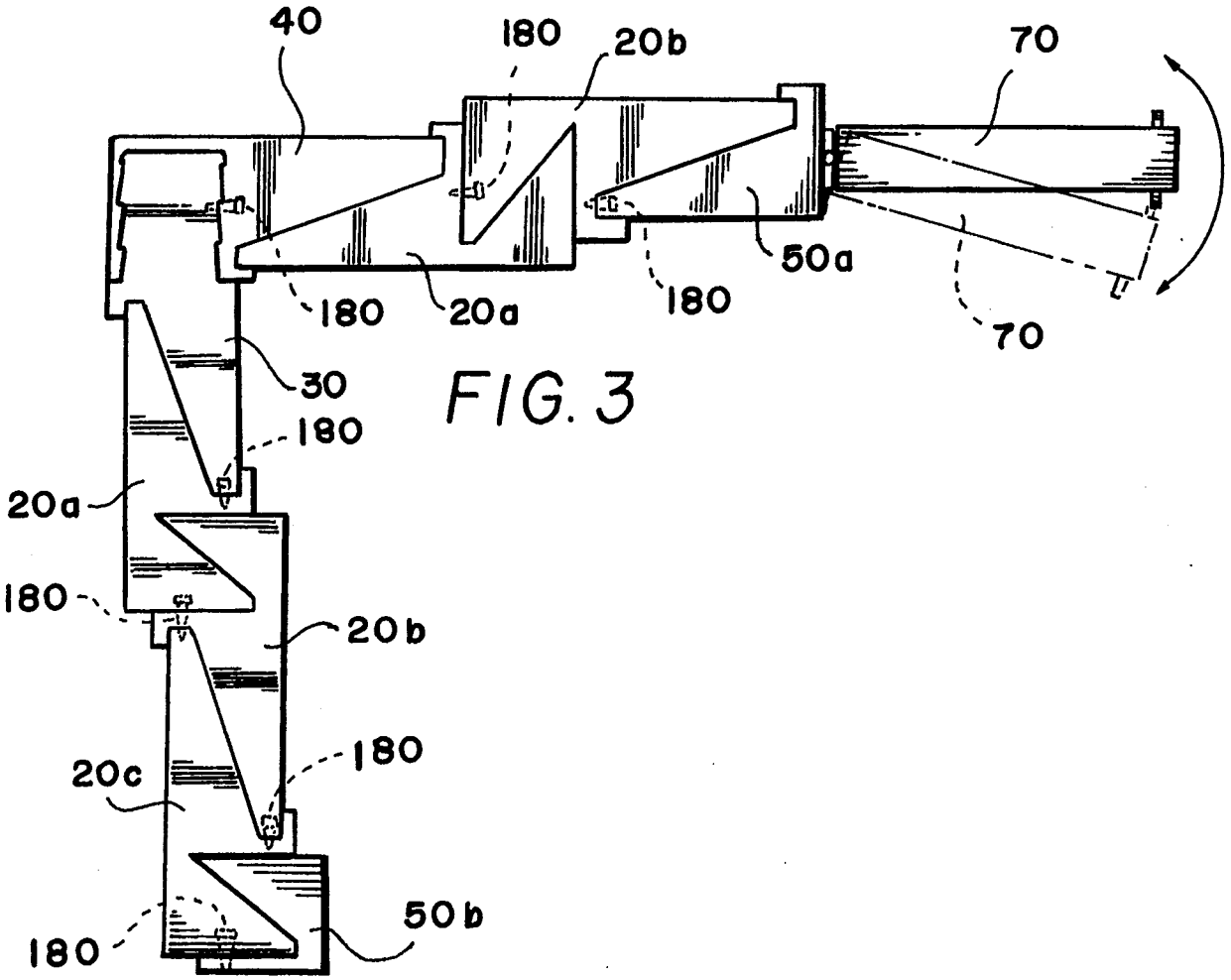
FIG. 3 is a top plan view of the present invention.

The end panel 50*a* shown in FIGS. 1 and 3, simply incorporates the structure of the aforementioned first cavity 100, excluding the structure constituting the second cavity 120. Similarly, an alternative end panel 50*b* may include only that structure constituting the second cavity 120, excluding that structure forming the first cavity 100.

FIGS. 1 and 3 illustrate the interconnection of the various fence panels. According to the FIG. 3, the fence panels are interconnected beginning with end panel 50*b* and successive panels are interconnected in a clockwise fashion. The unique configuration of these fence panels and the consecutive interconnection thereof ensures that each ensuing fence panel conceals the fasteners 80 which secure the preceding interconnected panels.

It is to be understood that the present invention is not limited to the embodiments described above, but encompasses any and all embodiments within the scope of the following claims.

We claim:

1. A modular security fence comprising:

a plurality of intermediate fence panels, each including:

a first cavity being bound by a first set of peripheral walls and a portion of a rear surface;

a second cavity being bound by a second set of peripheral walls and a remaining portion of said rear surface, said second cavity being disposed juxtaposed said first cavity;

a slidably engagable congruent surface;

a slidably engagable complementary surface; and securing means to secure said plurality of panels one to another;

a female corner panel including:

a cavity being bound by a set of peripheral walls and a portion of a rear surface;

a channel being bound by a set of parallel walls and a remaining portion of said rear surface, said channel being disposed juxtaposed said cavity; and a slidably engagable congruent surface, whereby one of said intermediate fence panels is invertingly and opposing directed toward said female corner panel such that said congruent surface of one of said intermediate fence panels is slidably engagable with said congruent surface of said female corner panel; and whereby one of said plurality of intermediate fence panels is invertingly and opposingly directed toward another one of said plurality of intermediate fence panels such that said congruent surface of one of said intermediate fence panels is slidably engagable with said congruent surface of said another one of said intermediate fence panels, said panels being fastened together by said securing means, and whereby said one of said plurality of intermediate fence panels is inverted and opposingly directed relative toward another one of said plurality of intermediate fence panels such that said complementary surface of said one of said intermediate fence panels is slidably engagable with said complementary surface of said another one of said intermediate fence panels, said panels being fastened together by said securing means, thus forming a plurality of successive engagable intermediate fence panels and, in turn, forming said modular security fence.

2. The security fence according to claim 1, further comprising a male corner panel including:

a cavity being bound by a set of peripheral walls and a portion of a rear surface;

an enclosure being bound by a second set of peripheral walls, a recessed portion of said rear surface, an upper wall, and a lower wall, said enclosure being disposed juxtaposed said cavity; and a slidable engagable congruent surface; whereby one of said intermediate fence panels is invertingly and opposingly directed relative toward said male corner panel such that said congruent surface of one of said intermediate fence panels is slidably engagable with said congruent surface of said male corner panel, said panels being fastened together by said securing means, and whereby said enclosure of said male corner panel is slidably engagable with said channel of said female corner panel, said panels being fastened together by said securing means, thus forming a plurality of successive engagable intermediate, male and female panels.

3. The security fence according to claim 2, wherein said parallel walls of said channel includes opposing inner surfaces, each being configured with slight inwardly directed, stepwise progressing ridges and wherein said enclosure includes slight outwardly directed, stepwise progressing ridges which couple with said stepwise progressing ridges of said female corner panel, thus forming male and female corner panels which mate to provide a snap fit configuration.

4. The security fence according to claim 3, wherein at least one of said intermediate panels include an electrical box recessed therein to accommodate an electrical device.

5. The security fence according to claim 4, wherein said electrical device includes a security device.

6. The security fence according to claim 5, wherein said security device includes a motion detection device.

7. The security fence according to claim 4, wherein said electrical device includes an electrical receptacle.

8. The security fence according to claim 4, wherein said electrical device includes a flush mount light fixture.

9. The security fence according to claim 4, wherein said electrical device includes a recess light fixture.

10. The security fence according to claim 3, further comprising an end piece slidably engagable with said intermediate panel, said male corner panel, and said female corner panel.

11. The security fence according to claim 10 , wherein said end piece includes:

a cavity being bound by a set of peripheral walls and a rear surface; and a slidably engagable congruent surface; whereby said intermediate fence panel, said male corner panel, and said female corner fence panel are each invertingly and opposed directed toward said end piece such that said congruent surface of said intermediate fence panel, said male corner panel, and said female corner panel are each slidably engagable with said congruent surface of said end piece, said panels being fastened together by said securing means, thus concealing said cavities.

12. The security fence according to claim 10, wherein said end piece includes:

a cavity being bound by a set of peripheral walls and a rear surface; and a slidably engagable complementary surface; whereby said intermediate fence panel is invertingly and opposingly directed toward said end piece such that said congruent surface of said intermediate fence panel is slidably engagable with said congruent surface of said end piece, said panels being fastened together by said securing means, thus concealing said cavities.

13. The security fence according to claim 1, further comprising a gate to permit a flow of traffic therethrough.

14. A modular security fence comprising:

a plurality of intermediate fence panels, each including:

a first cavity being bound by a first set of peripheral walls and a portion of a rear surface;

a second cavity bound by a second set of peripheral walls and a remaining portion of said rear surface, said second cavity being disposed juxtaposed said first cavity;

a slidably engagable congruent surface;.

a slidably engagable complementary surface; and securing means to secure said plurality of panels one to another, whereby one of said plurality of intermediate fence panels to invertingly and opposingly directed toward another one of said plurality of intermediate fence panels such that said congruent surface of one of said intermediate fence panels is slidably engagable with said congruent surface of said another one of said intermediate fence panels, said panels being fastened together by said securing means, and whereby said one of said plurality of intermediate fence panels is inverted and opposingly directed relative toward another one of said plurality of intermediate fence panels such that said complementary surface of said one of said intermediate fence panels is slidably engagable with said complementary surface of said another one of said intermediate fence panels, said panels being fastened together by said securing means, thus forming a plurality of successive engagable intermediate fences panels and, in turning forming said modular security fence; and wherein stakes project from a bottom of said security fence to provide auxiliary support for said security fence.

15. The security fence according to claim 14 further comprising a gate to permit a flow of traffic therethrough.

16. A modular security fence comprising:

a plurality of intermediate fence panels, each including:

a first cavity being bound by a first set of peripheral walls and a portion of a rear surface;

a second cavity being bound by a second set of peripheral walls and a remaining portion of said rear surface, said second cavity being disposed juxtaposed said first cavity;

a slidably engagable congruent surface;

a slidably engagable complementary surface; and securing means to secure said plurality of panels one to another;

an end panel slidably engagable with one of said intermediate panels;

wherein said end panel includes:

a cavity being bound by a set of peripheral walls and a rear surface; and a slidably engagable complementary surface; whereby said intermediate fence panel is invertingly and opposingly directed toward said end panel such that said congruent surface of said intermediate fence panel is slidably engagable with said congruent surface of said end panel, thus concealing said cavities; and whereby one of said plurality of intermediate fence panels is invertingly and opposingly directed toward another one of said plurality of intermediate fence panels such that said congruent surface of one of said intermediate fence panels is slidably engagable with said congruent surface of said another one of said intermediate fence panels, and whereby said one of said plurality of intermediate fence panels is inverted and opposingly directed relative toward another one of said plurality of intermediate fence panels such that said complementary surface of said one of said intermediate fence panels is slidably engagable with said complementary surface of said another one of said intermediate fence panels, said panels being fastened together by said securing means, thus forming a plurality of successive engagable intermediate fence panels and, in turn, forming said modular security fence.

17. The security fence according to claim 16, further comprising a gate to permit a flow of traffic therethrough.

18. The security fence according to claim 16, wherein stakes project from a bottom of said security fence to provide auxiliary support for said security fence.

* * * * *